US008696919B2

(12) United States Patent
Van Der Meer et al.

(10) Patent No.: US 8,696,919 B2
(45) Date of Patent: Apr. 15, 2014

(54) METHOD FOR MANUFACTURING A NOZZLE AND AN ASSOCIATED FUNNEL IN A SINGLE PLATE

(71) Applicant: Oce-Technologies B.V., Venlo (NL)

(72) Inventors: René J. Van Der Meer, Venlo (NL); Hubertus M. J. M. Boesten, Melick (NL); Maarten J. Bakker, 's Hertogenbosch (NL); David D. L. Wijngaards, Tegelen (NL)

(73) Assignee: Oce-Technologies B.V., Venlo (NL)

( * ) Notice: Subject to any disclaimer, the term of this patent is extended or adjusted under 35 U.S.C. 154(b) by 0 days.

(21) Appl. No.: 13/678,968

(22) Filed: Nov. 16, 2012

(65) Prior Publication Data

US 2013/0068724 A1 Mar. 21, 2013

Related U.S. Application Data

(63) Continuation of application No. PCT/EP2011/058292, filed on May 20, 2011.

(30) Foreign Application Priority Data

Jun. 2, 2010 (EP) ..... 10164708

(51) Int. Cl.
*B44C 1/22* (2006.01)

(52) U.S. Cl.
USPC ..... 216/41; 216/2; 216/27; 216/46; 216/51; 216/54; 216/67; 216/74; 216/79; 438/689; 438/710; 438/712; 438/719; 438/734; 438/736

(58) Field of Classification Search
None
See application file for complete search history.

(56) References Cited

U.S. PATENT DOCUMENTS

| | | | | |
|---|---|---|---|---|
| 5,131,978 | A | 7/1992 | O'Neill | |
| 6,648,454 | B1 | 11/2003 | Donaldson et al. | |
| 2001/0028378 | A1 * | 10/2001 | Lee et al. | 347/68 |
| 2009/0147049 | A1 | 6/2009 | Lee et al. | |

* cited by examiner

*Primary Examiner* — Lan Vinh
*Assistant Examiner* — Jiong-Ping Lu
(74) *Attorney, Agent, or Firm* — Birch, Stewart, Kolasch & Birch, LLP

(57) ABSTRACT

A method for manufacturing a nozzle and an associated funnel in a single plate comprises providing the single plate, the plate being etchable; providing an etch resistant mask on the plate, the mask having a pattern, wherein the pattern comprises a first pattern part for etching the nozzle and a second pattern part for etching the funnel; covering one of the first pattern part and the second pattern part using a first cover; etching one of the nozzle and funnel corresponding to the pattern part not covered in step (c); removing the first cover; etching the other one of the nozzle and funnel; and removing the etch resistant mask.

8 Claims, 3 Drawing Sheets

METHOD FOR MANUFACTURING A NOZZLE AND AN ASSOCIATED FUNNEL IN A SINGLE PLATE

CROSS REFERENCE TO RELATED APPLICATIONS

This application is a Continuation of PCT International Application No. PCT/EP2011/058292 filed on May 20, 2011, which claims priority under 35 U.S.C. §119(a) to Patent Application No. 10164708.9 filed in the European Patent Office on Jun. 2, 2010, all of which are hereby expressly incorporated by reference into the present application.

FIELD OF THE INVENTION

The present invention generally pertains to manufacturing of a nozzle in a plate.

SUMMARY OF THE INVENTION

In an aspect of the present invention, a method for manufacturing a nozzle and connected funnel is provided. In particular, the method according to the present invention uses a single mask for manufacturing the funnel and the nozzle in a single plate, thereby preventing misalignment of the funnel and nozzle. The method according to the present invention comprises (a) providing the single plate, the plate being etchable;
(b) providing an etch resistant mask on the plate, the mask having a pattern, wherein the pattern comprises a first pattern part for etching the nozzle and a second pattern part for etching the funnel;
(c) covering one of the first pattern part and the second pattern part using a first cover;
(d) etching one of the nozzle and funnel corresponding to the pattern part not covered in step (c);
(e) removing the first cover;
(f) etching the other one of the nozzle and funnel;
(g) removing the second cover and the etch resistant mask.

In an embodiment, step (c) comprises covering the first pattern part; step (d) comprises etching the nozzle; and step (f) comprises etching the funnel.

In the method according to the present invention, a mask, e.g. a single-layered mask, defines a position of the nozzle and the funnel. The mask is provided using a method wherein all pattern parts are aligned by way of a single alignment with the plate and any structure on the plate, if any, while the accuracy of the mask determines the accuracy between the structures to be provided using the mask, since a boundary of an etched part of the single plate is defined by a boundary of the pattern of the etch-resistant mask. The (first) cover merely covering a part of the pattern, in particular fully covering openings of the pattern such that the part of the pattern that is not covered is determined by a boundary of other openings that are part of the pattern. As a consequence, the position of the nozzle relative to the position of the funnel is defined by the accuracy of (a boundary of) the mask. Hence, selecting and employing a highly accurate method of manufacturing and using the mask results in a highly accurate relative positioning of nozzle and funnel. In an embodiment, the second step of etching, i.e. step (f) is preceded by a step of covering the other one of the first pattern part and the second pattern part using a second cover and step (g) further comprises removing the second cover such as to protect the etched nozzle against the second etching step. In an embodiment, the mask may be provided using lithographic techniques. Such lithographic techniques provide the above-mentioned high accuracy of the relative positions of the nozzle and funnel.

The above method is suitable for use in a method wherein a single plate is provided with a nozzle using etching, for example. In particular, the single plate may be made of silicon, which is very suited to be highly accurately processed by etching, as is well known in the art. In an embodiment, the etch processing may comprise Deep Reactive-Ion Etching, which is a well-known prior art method. Such an etching method is for example suitable for etching a nozzle. Further, in an embodiment, the etch processing may comprise Anisotropic Etching, which is a well-known prior art method. Such an etching method is for example suitable for etching the funnel, depending on the intended shape of the funnel. Of course, the first cover and the second cover (if any) need to be resistant to the kind of etching being performed.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinafter and the accompanying schematical drawings which are given by way of illustration only, and thus are not limitative of the present invention, and wherein.

DETAILED DESCRIPTION OF THE DRAWINGS

Figure 1:
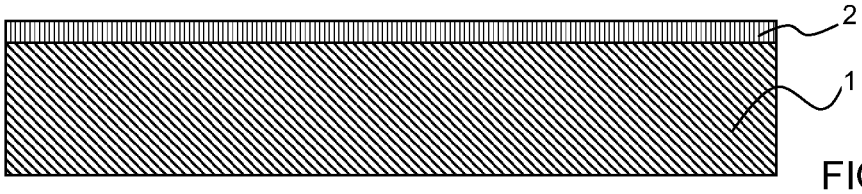
FIGS. 1-12 illustrate a first embodiment of a method according to the present invention.

The present invention will now be described with reference to the accompanying drawings, wherein the same reference numerals have been used to identify the same or similar elements throughout the several views.

FIG. 1 shows a plate 1 provided with a patternable layer 2. The plate 1 may be made of silicon, for example, or from any other suitable material for performing the hereinafter described method and suitable for use as a nozzle plate e.g. for use in an inkjet print head. The patternable layer 2 may be an oxidized layer, suitable for being patterned by lithographic processing.

For use in an inkjet print head, such a nozzle plate has an outer surface in which an orifice is formed through which a droplet of ink may be expelled. A diameter of the orifice and a length of the orifice each have an influence of the forming of the droplet, the size of the droplet, a direction of movement of the droplet, satellite droplet forming and other aspects of the droplet forming. Hence, the shape of the orifice needs to have a shape accurately corresponding to a predetermined desired shape. Further, at an other side, usually an opposite side, of the nozzle plate the orifice is coupled to an ink chamber, in which an amount of ink is held and in which a pressure wave may be generated using well-known and common methods, for example by heating (thermal inkjet) or using a piezo actuator. Also other actuation methods (i.e. pressure generating methods) may be used. The orifice may have any suitably formed cross-section. For example, the orifice may have a circular or a square cross-section.

Since the ink chamber usually has a larger diameter than the orifice, it is known to use a funnel between the ink chamber and the orifice. The funnel provides a gradual transition from the large ink chamber to the small orifice. As such the funnel may be conically shaped or may have a pyramid shape, for example. However, other shapes may be used as well. The shape of the funnel may have a significant influence on the droplet forming similar to the above-described influence of the orifice. Further, the alignment between the funnel and the orifice may have a significant influence on the droplet forming. For example, it has been found that a direction of movement of a droplet expelled through the orifice may be slanted compared to a central axis of the orifice, when the funnel and orifice are misaligned. Therefore, in the described and illustrated embodiment of the method according to the present invention, a suitably shaped orifice and a suitably shaped funnel are provided in the plate 1 such that each will be accurately shaped and they will be accurately aligned relative to each other.

Figure 2:
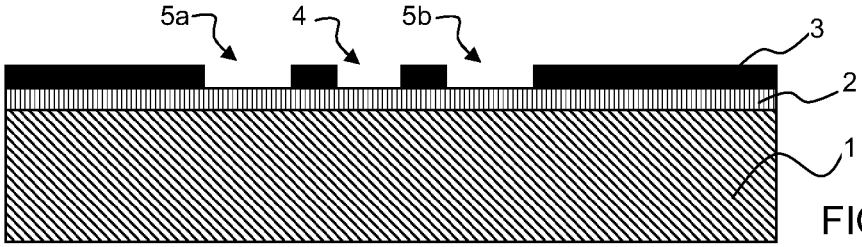

As shown in FIG. 2, the plate 1 and in particular on the patternable layer 2, a mask 3 is provided. The mask 3 is configured to be used in a lithographic process such that the patternable layer 2 may be accurately patterned using such lithographic process. The mask 3 is provided with a pattern and in particular with a first pattern part 4 and a second pattern part 5*a*, 5*b* (hereinafter together also referred to as the second pattern part 5). Each pattern part 4, 5 comprises one or more openings in the mask 3. An opening may be part of one of the pattern parts 4, 5 or may be part of both pattern parts 4, 5. However, the pattern parts 4, 5 are not equal, so at least one opening is not comprised in both pattern parts 4, 5.

Figure 3:
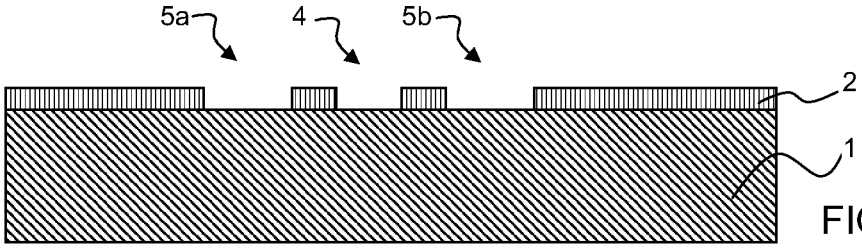

The first pattern part 4 is provided and configured for etching a nozzle and the second pattern part 5 is provided and configured for etching a funnel. As the patterns for etching each of the nozzle and the funnel are provided in a single mask and the boundary of the openings of the pattern parts 4, 5 determine the boundary of the etched parts, the accuracy of the mask 3 determines the alignment of the nozzle and the funnel to be formed. Since such a mask 3 and the lithographic process are very accurate, any misalignment (if any) will be limited. After lithographic processing, the pattern parts 4, 5 of the mask 3 will be copied in the patternable layer 2 and the mask 3 may be removed. The plate 1 with a patterned layer 2 as shown in FIG. 3 results.

Figure 4:
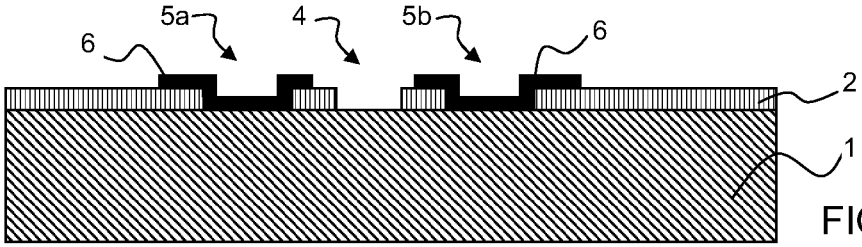
Figure 5:
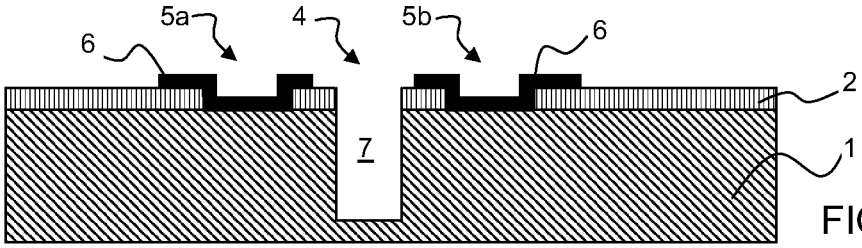

For forming the nozzle, Deep Reactive-Ion Etching may be employed, which is suitable for etching a relatively straight pipe-shaped hole in the plate 1, as known in the art. Therefore, such etching is to be performed at the location of the first pattern part 4. In order to prevent that similar holes are provided at the locations of the second pattern parts 5*a*, 5*b* a suitable deep reactive-ion etch resistant material is provided at those locations as a first cover 6. The first cover 6 may be positioned with low accuracy, since the accuracy required for the etching process is provided by the (boundary of the) masking patterned layer 2. The first cover 6 may, as illustrated in FIG. 4, overlap with the masking patterned layer 2, thereby effectively fully covering the second pattern parts 5*a*, 5*b*. After deep reactive-ion etching, or any other suitable etch processing, a nozzle hole 7 is provided through the masking patterned layer 2 as illustrated in FIG. 5.

Figure 6:
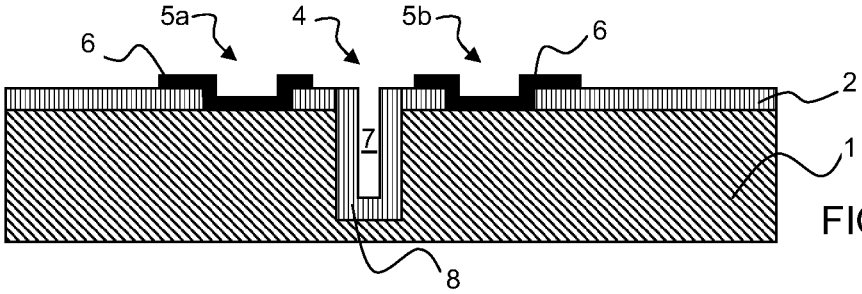
Figure 7:
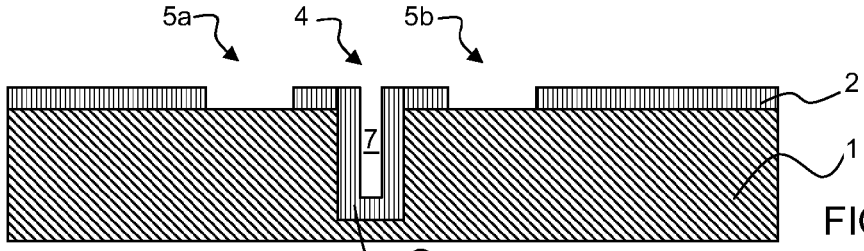

For protecting the formed nozzle hole 7 during further etch processing, walls of the nozzle hole 7 are then treated, e.g. oxidized, forming a masking layer 8, resulting in the plate as illustrated in FIG. 6. For providing the funnel, the first cover 6 is removed resulting in the plate 1 as shown in FIG. 7.

Figure 8:
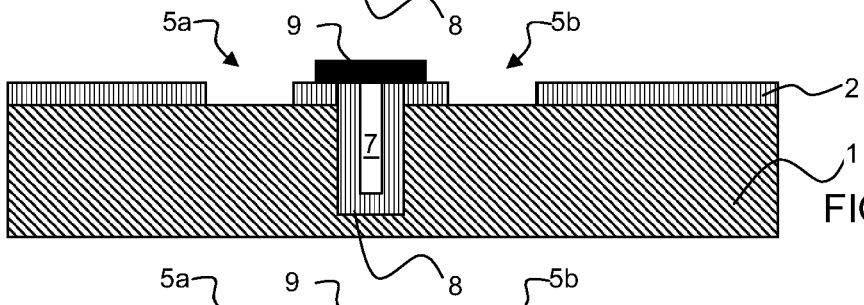
Figure 9:
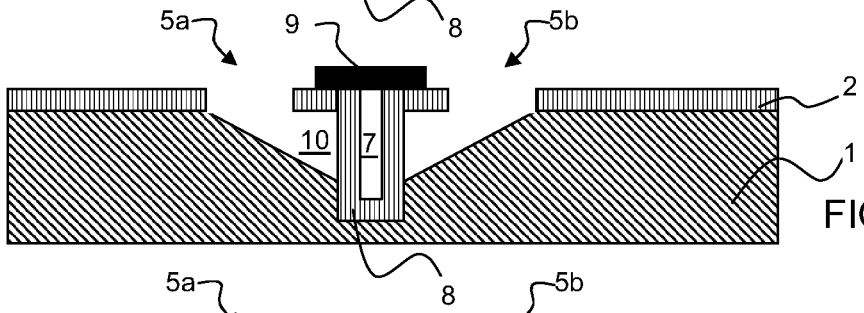

Then, in the illustrated embodiment, in FIG. 8, a second cover 9 is provided fully covering the opening(s) of the first pattern part 4. Such a second cover 9 is optional, since the masking layer 8 is provided on the walls of the nozzle hole 7.

Figure 10:
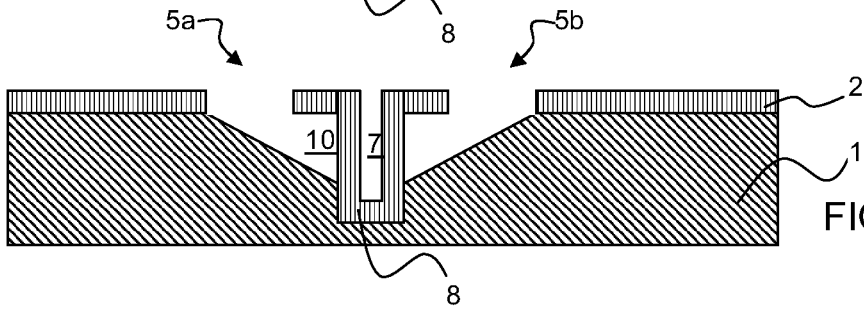

Employing anisotropic etching using TMAH or KOH as known in the art, or any other suitable etch processing, a funnel portion 10 may be provided. The etching follows the silicon crystal plane at 54.74 degrees and stops at the etch resistant masking layer 8 as shown in FIG. 10. Removal of the masking patterned layer 2 and the masking layer 8 results in the plate 1 being formed as shown in FIG. 11.

Figure 11:
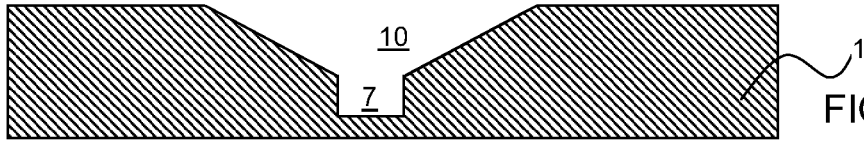
Figure 12:
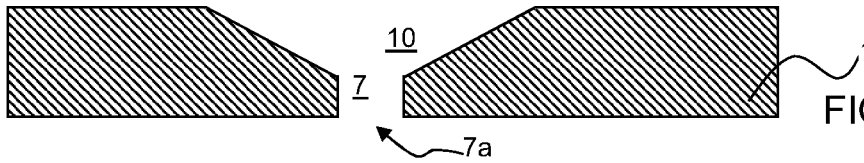

In FIG. 11, the nozzle hole 7 is not a through hole. So, by suitable processing, chemically or mechanically, a layer may be removed from the plate 1 such that the nozzle hole 7 becomes a through hole thereby forming the nozzle 7*a* as shown in FIG. 12. In another embodiment, the plate 1 may have been provided with a removable layer (a handle or box layer), which may be easily removed, thereby providing the result as shown in FIG. 12.

Figure 13:
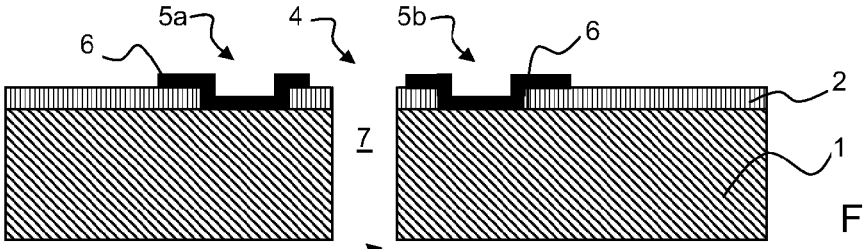
FIGS. 13-17 illustrate a second embodiment of a method according to the present invention.
Figure 14:
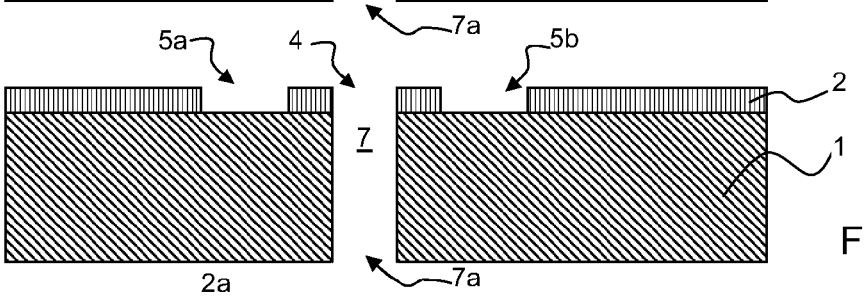

In a second embodiment the processing starts with the steps described in relation to and shown in FIGS. 1-4. Then, in the second embodiment, the nozzle hole 7 is etched, for example using deep reactive-ion etching, or any other suitable method, through the plate 1 such that a nozzle 7*a* is obtained in a side of the plate 1 opposite to the side on which the masking patterned layer 2 is provided, as shown in FIG. 13. Thereafter, the first cover 6 is removed arriving at the plate 1 as shown in FIG. 14.

Figure 15A:
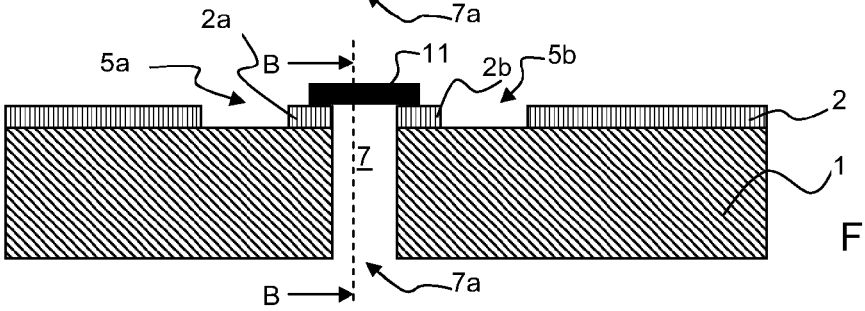
Figure 15B:
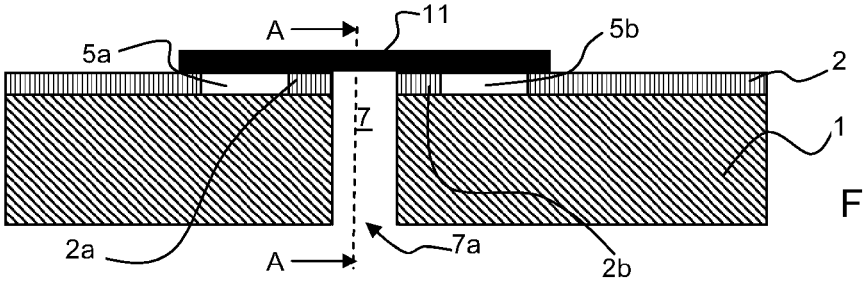

For providing the funnel a second cover 11 is provided over the first pattern part 4 as shown in FIGS. 15A-15B. The cross-section of the plate 1 as shown in FIG. 15B is a cross-section taken perpendicular to the cross-section shown in FIG. 15A at the position indicated by the dotted line and corresponding arrows B-B. In the cross-section shown in FIG. 15A, the second cover 11 only covers the first pattern part 4 and hence the nozzle hole 7. In the cross-section shown in FIG. 15B, the second cover 11 extends over the first pattern part 4 and the second pattern part 5. Preferably, but not necessarily, the second cover 11 is attached to patterned layer parts 2*a*, 2*b*, for example by usage of suitable glue, or the like, such that when an underlying part of the plate 1 is removed by etching, the patterned layer parts 2*a*, 2*b* remain attached to the second cover 11.

As the second cover 11 extends over the second patterns parts 5*a*, 5*b* (FIG. 15B), when the underlying part of the plate 1 is removed, the second cover 11 and, if attached, the patterned layer parts 2*a*, 2*b* will stay in place. On the other hand, since the second cover 11 does not completely cover the second pattern parts 5*a*, 5*b* (FIG. 15A), when etch fluid is provided in the second pattern parts 5*a*, 5*b*, the fluid may flow under the second cover 11 and may thus also etch below the second cover 11 in the second pattern parts 5*a*, 5*b* as shown in FIG. 15B.

Figure 16:
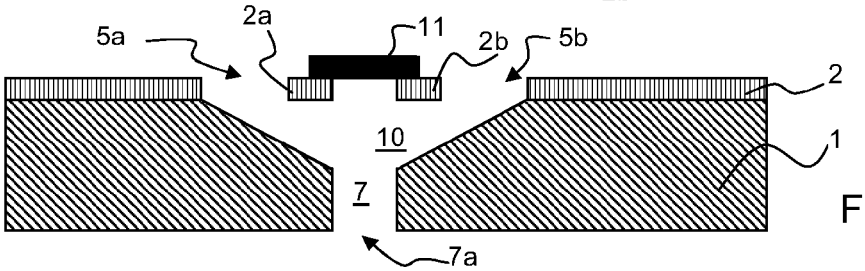

Now referring to FIG. 16, showing a cross-section corresponding to the cross-section as shown in FIG. 15A, a funnel 10 is etched, e.g. using anisotropic etching, or any other suitable method, by providing an etching fluid only at the side of the plate 1 having the patterned layer 2 thereon. The etching fluid follows the silicon crystal plane at 54.74 degrees and continues until the etching fluid arrives in the nozzle hole 7. Since the nozzle hole 7 is opened at the opposite side ( ), the etching fluid arriving at the nozzle hole 7 may be removed through the nozzle 7*a*, thereby preventing further etching of the nozzle hole walls. Please note, that the second cover 11 and the patterned layer parts 2*a*, 2*b* as shown in FIG. 16 are still supported on the patterned layer 2 in a cross-section perpendicular to the shown cross-section (FIG. 15B).

Figure 17:
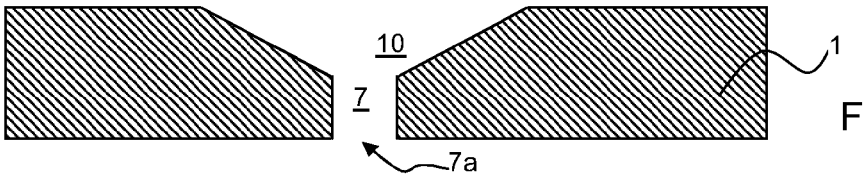

Removing the second cover 11 and the patterned layer 2 results in the plate 1 having the funnel 10 and the nozzle hole 7 with the nozzle 7*a* as illustrated in FIG. 17. Compared to the result of the first embodiment, as shown in FIG. 12, the nozzle hole 7 may have a larger length (axial direction). However, further chemical or mechanical processing may be employed to provide a desired length to the nozzle hole 7. Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A method for manufacturing a nozzle and a connected funnel in a single plate, the method comprising:

(a) providing the single plate, the plate being etchable;

(b) providing an etch resistant mask on the plate, the mask having a pattern of mask openings exposing a surface of the plate to be etched, wherein the pattern comprises a first pattern part for etching the nozzle and a second pattern part for etching the funnel;

(c) covering one of the first pattern part and the second pattern part using a first cover;

(d) etching one of the nozzle and funnel corresponding to the pattern part not covered in the step (c);

(e) after the step (d), removing the first cover;

(f) after removing the first cover, etching the other one of the nozzle and funnel; and (g) after etching both nozzle and funnel, removing the etch resistant mask.

2. The method according to claim 1, wherein the step (f) comprises, prior to etching, covering the other one of the first pattern part and the second pattern part using a second cover and wherein the step (g) further comprises removing the second cover.

3. The method according to claim 1, wherein the step (c) comprises covering the second pattern part;

the step (d) comprises etching the nozzle; and the step (f) comprises etching the funnel.

4. The method according to claim 1, wherein the single plate is made of silicium.

5. The method according to claim 1, wherein the step (b) comprises:

b1) providing an etch-resistant patternable layer on a side of the plate provided in the step (a);

b2) positioning a lithographic mask on the etch-resistant patternable layer provided in the step (b1);

b3) using lithographic techniques for patterning the etch-resistant patternable layer corresponding to a mask pattern arranged in the lithographic mask; and b4) removing the lithographic mask, the etch-resistant patternable layer thereby becoming the etch-resistant mask.

6. The method according to claim 1, wherein the cover for covering the second pattern part is a cover resistant to Deep Reactive-Ion Etching and wherein Deep Reactive-Ion Etching is employed for etching the nozzle in the corresponding one of the step (d) and the step (D.

7. The method according to claim 2, wherein the cover for covering the first pattern part is a cover resistant to Anisotropic Etching and wherein Anisotropic Etching is employed for etching the funnel in the corresponding one of the step (d) and the step (f).

8. The method according to claim 3, wherein after the step (d) a wall of the nozzle is made etch resistant.

* * * * *